United States Patent [19]

Worst

[11] 4,258,921

[45] Mar. 31, 1981

[54] GOLF BALL

[76] Inventor: Joseph C. Worst, 3606 Nandina Dr., Louisville, Ky. 40222

[21] Appl. No.: 109,645

[22] Filed: Jan. 4, 1980

[51] Int. Cl.[3] ..... A63B 37/14; A63B 69/36

[52] U.S. Cl. ..... 273/232; 40/327; 273/183 C

[58] Field of Search ..... 273/232, 213, 62, 58 K, 273/183 C; 40/327

[56] References Cited

U.S. PATENT DOCUMENTS

| | | | |
|---|---|---|---|
| 676,506 | 1/1901 | Knight et al. | 273/213 |
| 878,254 | 2/1908 | Taylor | 273/232 |
| 1,666,699 | 4/1928 | Hagen | 273/232 |
| 1,681,167 | 8/1928 | Beldam | 273/232 |
| 1,716,435 | 6/1929 | Fotheringham | 273/232 |
| 2,539,303 | 1/1951 | Gerke et al. | 273/232 X |
| 3,819,190 | 6/1974 | Nepela et al. | 273/232 |
| 4,142,727 | 3/1979 | Shaw et al. | 273/232 |

FOREIGN PATENT DOCUMENTS

| | | | |
|---|---|---|---|
| 8464 | of 1911 | United Kingdom | 273/232 |
| 20778 | of 1911 | United Kingdom | 273/232 |

*Primary Examiner*—George J. Marlo

[57] ABSTRACT

A golf ball is shown with an outer surface that is substantially covered with a plurality of spaced dimples that give the ball a suitable long and predictable flight pattern for wood or iron shots due to imparting an increased lift to the ball when the ball has a backspin. An undimpled patch is formed on the outer surface for use as a smooth putter-contacting surface. The size of the undimpled patch is chosen to achieve the desired putting accuracy objective without detracting from the increased "hang" time of the flight of the ball. The center of the undimpled patch is substantially spaced between about 90° and 100° from the center of the imprint of the brand name of the ball manufacturer, so the ball may be positioned for putting with the brand name indicia located at the top of the ball, and the location of the undimpled patch being easily discernible from above by the golfer as he stands over the ball and prepares to putt.

9 Claims, 6 Drawing Figures

GOLF BALL

BACKGROUND OF THE INVENTION

1. Field of the Invention

This invention relates to the configuration of the outer surface of golf balls, and particularly to such designs which relate to the pattern of the dimpled surface area of the ball so that when the ball is hit by a putter it will assume a more accurate, predetermined, directional roll.

2. Description of the Prior Art

A pioneer patent in the art of golf balls is the Taylor U.S. Pat. No. 878,254 of Feb. 4, 1908 which taught for the first time that the outer surface of a golf ball should be provided with a plurality of spaced dimples which substantially cover the outer surface. The advantage of this dimpled surface is that it gives stability in flight and also increased lift to the ball. In the words of the Taylor patent, "Its principal object is to obtain better results in the flight of the ball in the direction of a sustained hanging flight giving a flat trajectory with a slight rising tendency particularly toward the end of the flight, than have been possible with balls of known types." A smooth surfaced ball that is driven by a given force at a given angle would stay in the air only 2 seconds, while the Taylor dimpled ball would stay in the air 5 seconds for a good wood shot. This is due to the turbulent air action caused by the dimples on the forward moving ball which is back-spinning. The Taylor dimples take advantage of the Bernoulli Effect, which is well known in the science of aerodynamics. To create a vacuum over the top surface of the ball which causes the ball to rise and have a longer "hang" time in flight. The teachings in this Taylor patent are believed to be found in every golf ball on the market at the present time.

The Hagen U.S. Pat. No. 1,666,699 relates to a golf ball surface configuration comprising annular recesses completely covering the ball. These recesses have concavely curved outer walls and convexly curved inner walls with the result that the outer surface is more nearly smooth all over. Hagen asserts that his golf ball is more accurate in flight and also in putting or rolling along the surface of the ground.

The Beldam U.S. Pat. No. 1,681,167 describes the surface configuration of a golf ball where the primary object is to provide a form or character of surface by which a better "grip" of the club with the ball is obtained without slip or relative movement. Also the surface configuration furnishes a better "grip" of the "green", and hence a truer run. The outer surface is filled with rectangular recesses that are surrounded by cross ribs.

The Fotheringham U.S. Pat. No. 1,716,435 is very similar to the Hagen U.S. Pat. No. 1,666,699 in that it describes a golf ball that is covered with a plurality of annular recesses having concavely curved outer walls. This renders a golf ball that is more nearly smooth all over.

The Nepela et al U.S. Pat. No. 3,819,190 describes a golf ball having dimples in a wide band extending completely around the ball, and the diametrically opposed undimpled portions outside this band having fewer or no dimples allegedly "to decrease the drag on the ball while leaving the lift characteristics substantially the same thereby to cause the ball, for a given striking force, to exhibit directional control." The force tending to slow a conventional golf ball as it travels through the air is commonly referred to as drag. The drag is proportional to the planar area of the ball pushing through the air. With the air film spinning with the ball, the effective planar area of the ball is increased thereby increasing the drag forces imparted on the ball. The patent states that, "any detrimental forces acting to slow the ball in flight will reduce the distance the ball travels." This Nepela patent teaches concentrating the dimples in a circumferential band centered about a circumferential line or great circle around the ball. Then the ball is teed with the plane of the band aimed along the desired direction of flight. This patent states, "By making the surface regions outside the band smoother, i.e., fewer dimples, less air turbulence results and a thinner film of air is carried by these areas thereby reducing the drag on the ball." This patent also states, "For putting, the undimpled areas between dimples form an even spherical surface for control of the ball." The patent states that the large undimpled areas exhibit a spinning "barbell effect", thereby doing away with the sidewise spin which would cause curving of the flight path.

The Shaw et al U.S. Pat. No. 4,142,727 has a golf ball with a surface pattern of dimples arranged to provide at least 12 and as many as 30 symmetrically disposed bald patches. The purpose of these bald patches is to increase the distance of the ball, but the statistics given in this patent appear to show a minuscule improvement of 2 yards in 230 yards. This patent does not discuss any change or improvement in the putting of the ball. Also each bald patch is narrow and elongated in shape; i.e. a width of 0.856 dimple diameters and an area of 4.01 times the mean dimple area. These bald patches are too small for serving as putting targets.

Also, it is known in the prior art to imprint the brand name of the manufacturer on the cover of the ball, and to assist this procedure an undimpled patch may be reserved of such a size to provide a smooth surface for printing only.

OBJECTS OF THE PRESENT INVENTION

The principal object of the present invention is to provide a long-flight dimpled golf ball with an optimum undimpled patch for use as a smooth putter-contacting surface to obtain a more accurate directional control of the ball during putting.

A further object of the present invention is to provide a dimpled golf ball of the class described with a pair of diametrically opposed undimpled patches to obtain near perfect symmetry of the mass of the ball.

A further object of the present invention is to provide a dimpled golf ball of the class described with directional indicator means for locating the putter-contacting surface when the golfer has positioned himself over the ball in readiness for putting.

A further object of the present invention is to provide a dimpled golf ball with an undimpled patch of minimum area having its center disposed below the equator of the ball as measured from the brand name indicia of the ball.

A further object of the present invention is to provide a dimpled golf ball of the class described with an undimpled patch that is oriented with respect to the imprinted brand name of the ball manufacturer so the brand name may be used as a locating or directional indicator means for the undimpled patch.

SUMMARY OF THE INVENTION

The present invention provides a spherical golf ball having in its outer surface a plurality of spaced dimples which substantially cover the outer surface. At least one undimpled patch is formed on the outer surface of the ball for use as a smooth putter-contacting surface. The undimpled patch has a minimum area equal to about four times the mean area of the dimples, and a maximum area equal to about sixteen times the mean area of the dimples.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
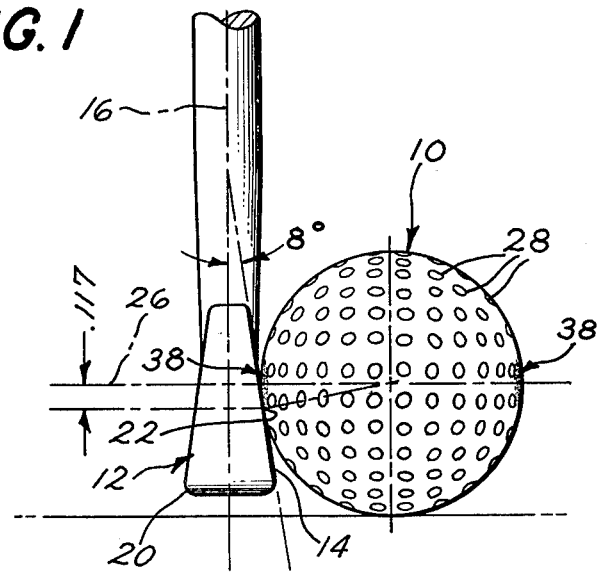
FIG. 1 is an elevational view of a spherical golf ball and a standard putter having about an 8° loft measured between the longitudinal axis of the shaft of the putter and the striking face of the putter showing that the normal or desired point of contact between the putter face and the ball is about 0.117" below the horizontal midplane of the ball.

Turning now to a consideration of the drawings and, in particular, to the back side elevational view of a spherical golf ball 10, it is shown being contacted by a standard putter 12. The face 14 of the putter can have about an 8° loft or angle as measured from the longitudinal center plane 16 through the shaft 18 and head 20 of the putter. Thus when the putter is maintained vertical, and the putter face contacts the ball, the contact is a point 22 that is spaced beneath the horizontal midplane 26 by about 0.117 inches. The standard diameter size of the ball is about 1.68 inches. The best golf ball for putting would be one with a smooth cover without any dimples or indentations; however, such a ball would be very impractical for any shots other than putting, as is taught by the basic Taylor U.S. Pat. No. 878,254 which was described above.

A golf ball must have an adequate number of shallow dimples 28 for the ball to have a suitable and predictable flight pattern for wood and iron shots. A standard dimple has a surface diameter of about 0.127 inches, and an average number of dimples on a standard golf ball is about 335 dimples, although there appears to be a drift toward fewer dimples per ball. The area of a dimple is $(\pi d^2)/4=0.0127$ sq. in. The total area of 335 dimples=4.241 sq. in. The total surface area of a standard golf ball is $\pi d^2=8.867$ sq. in. Thus the percent of total surface area having dimples=47.83%.

Figure 2:
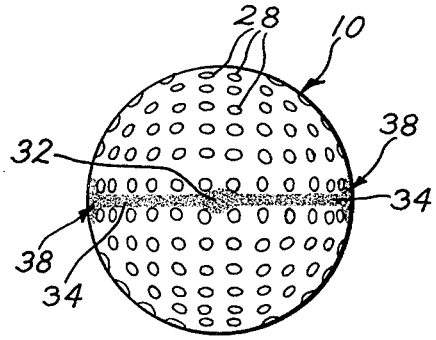
FIG. 2 is a top plan view of a golf ball of the present invention positioned for putting, showing the brand name indicia located at the very top of the ball, and a color band circumscribing the ball and passing through the indicia to serve as a directional indicator means.

Looking at the top plan view of FIG. 2 showing the golf ball 10 of the present invention, the manufacturer's brand name indicia 32 is shown at the very top of the ball. Actually, such indicia would be printed on both the top and bottom poles of the ball, as is standard in this art.

A color band 34 is shown encircling the ball in a great circle and passing through the top and bottom indicia 32. The color of the band 34 should be a color different from the white color of the cover of the ball so that it is easily discernible by the player standing over the ball in a putting position.

Figure 3:
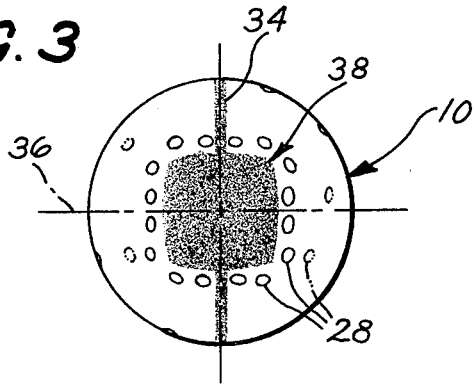
FIG. 3 is a right side elevational view of the golf ball of FIG. 2 showing the outer surface of the ball substantially covered by a plurality of spaced, shallow dimples except for an undimpled patch that serves to provide a smooth putter-contacting surface. The color band of FIG. 2 is shown passing down through the undimpled patch. This undimpled patch shown is the one of maximum size according to the present invention.

Now looking at the right side elevational view of FIG. 3, the horizontal midplane of the ball is identified as 36. Notice the smooth, undimpled patch 38 that is generally centered on the midplane 36 for use as a smooth putter-contacting surface. This undimpled patch 38 is of the maximum desired area and is equal to about sixteen times the mean area of the dimples. In other words, about sixteen dimples 28 have been removed from the cover molding dies (not shown) before the cover halves are molded to the core of the ball. For the sake of symmetry and convenience, a similar undimpled patch 38 may be formed on the side of the ball that is diametrically opposite the first patch 38 on a great circle of the ball. Hence FIG. 3 may be considered as both a right and a left side elevational view of the ball since one side of the ball is a mirror image of the opposite side. Thus it will be understood that the color band 34 serves as a directional indicator means to point out to the player the direction in which the ball will roll if the undimpled patch 38 is struck on the color band by the putter face 14.

It is felt that to obtain the best directional control of putting, it is important that the flat face 14 of the putter 12 contact a smooth spherical surface 38 of the ball, rather than to contact the narrow edge of a dimple formation. Since the cover of the ball dos not compress when putted, the smooth spherical surface 38 can be a rather small area. However the undimpled area should be large enough for a player to set the ball on the green without undue time-consuming effort, and accurately enough so that the player may be assured that the putting stroke will contact a true spherical ball surface. Also, the undimpled patch 38 should be large enough to allow putters having either small or large loft angles to contact the true spherical ball surface.

It is the spirit of this invention to have a golf ball which has a very small percentage of total surface area that is smooth and undimpled for improved putting accuracy, as well as a very large surface area having dimples for wood and iron shots.

FIG. 3 has an undimpled patch 38 of maximum area to encompass about sixteen dimples.

Figure 4:
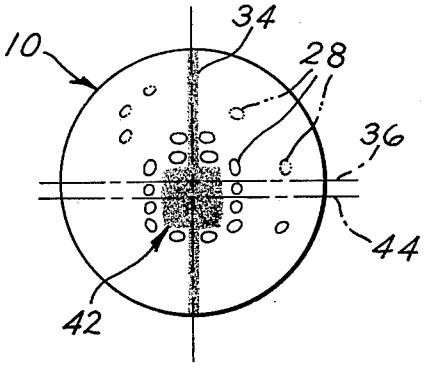
FIG. 4 is a side elevational view similar to that of FIG. 3, except that it shows an undimpled patch of the minimum size according to the present invention. Notice that almost all of the undimpled patch is positioned in the lower half of the ball beneath the horizontal midplane of the ball.

FIG. 4 is a right side elevational view similar to that of FIG. 3, but showing an undimpled patch 42 of minimum area equal to about four times the mean area of the dimples of the ball. In other words, about four dimples have been removed from the cover molding dies. Notice that the horizontal center line 44 through the minimum undimpled patch 42 is located beneath the horizontal midplane 36 of the ball, and that substantially all of this patch 42 is located below the horizontal midplane or equator 36 of the ball. Hence, as is seen in FIG. 1, a standard putter 12 with about an 8° loft may contact the approximate center of the patch 42 in the lower half of the ball.

Figure 5:
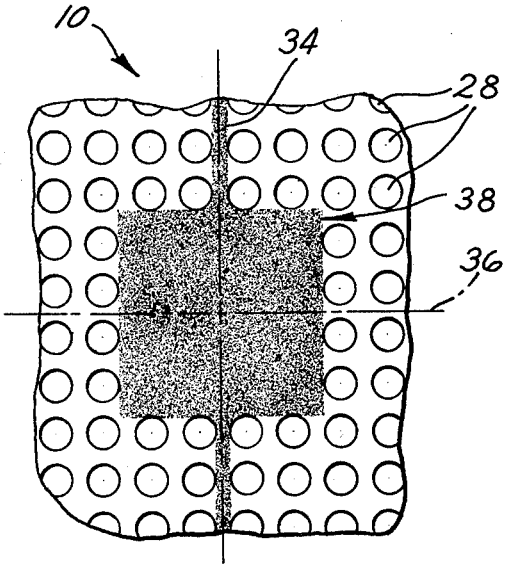
FIG. 5 is a fragmentary layout of the cover of the ball, on an enlarged scale, taken in the vicinity of the maximum size undimpled patch shown in FIG. 3. Notice that this undimpled patch is shown centered on the horizontal midplane of the ball.
Figure 6:
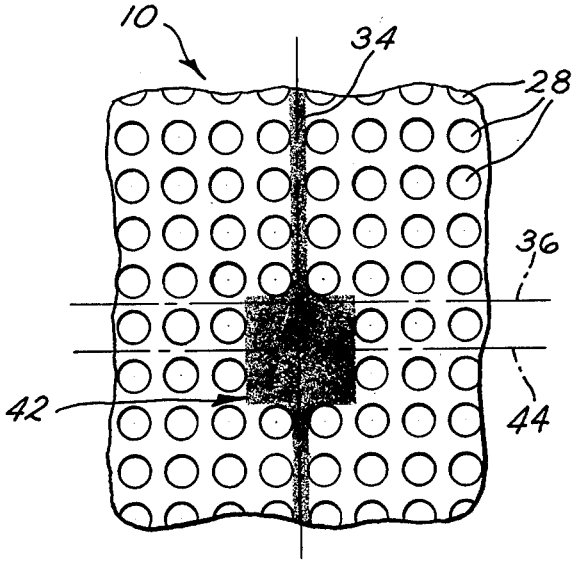
FIG. 6 is a view similar to FIG. 5 except that it shows the minimum size undimpled patch shown in FIG. 4. Notice that almost all of the undimpled patch is positioned beneath the horizontal midplane of the ball.

Having described above an optimum invention of a golf ball that is specially designed for accurate putting that likewise has a suitable long and predictable flight pattern, it will readily be apparent to those skilled in this art that many different variations may be made without departing from the scope of the invention. The undimpled patch may be centered on the horizontal midplane so the center of the patch is spaced about 90° from the center of the brand name indicia 32, as is seen in FIG. 5. Or the undimpled patch may be disposed beneath the horizontal midplane so the center of the patch is spaced about 100° from the center of the brand name indicia, as is seen in FIG. 6. The minimum and maximum size patches may be used either way, as outlined above. The color band 34 may encircle the ball or it may be used on only a segment thereof. The two undimpled patches may be diametrically opposed, or offset slightly therefrom.

Modifications of this invention will occur to those skilled in this art. Therefore, it is to be understood that this invention is not limited to the paticular embodiments disclosed, but that it is intended to cover all modifications which are within the true spirit and scope of this invention as claimed.

What is claimed is:

1. A golf ball in the shape of a sphere having a multiplicity of spaced apart dimples distributed generally uniformally over the outer surface thereof and having a continuous spherical surface between said dimples, the invention comprising:

a. at least one undimpled patch on the outer surface of the ball for use as a smooth putter-contacting surface;

b. the extent of the undimpled patch ranging from a first minimum size and shape corresponding to the undimpled area achieved by removing four of the dimples on the ball, said four dimples being arranged generally in the pattern of a square;

c. a second maximum area corresponding to the smooth undimpled area achieved by removing sixteen of the dimples on the ball, said sixteen dimples being arranged generally in the shape of a square, whereby the golf ball exhibits more accurate directional control during putting without significantly detracting from hang time of the ball in flight.

2. The invention as recited in claim 1, wherein there are at least two undimpled patches on the outer surface of the ball that are substantially diametrically opposed to each other and positioned on a great circle of the sphere.

3. The invention as recited in claims 1 or 2 wherein an indicia is marked on the outer surface of the ball, the center of said indicia being substantially spaced about 90° from the center of the undimpled patch.

4. The invention as recited in claims 1 or 2 wherein at least some of the undimpled patch has a color that is distinguishable from the color of the outer surface of the ball.

5. The invention as recited in claims 1 or 2 wherein at least one indicia is marked on the outer surface of the ball, the center of said indicia being substantially spaced about 90° from the center of the undimpled patch, and a color band positioned on the outer surface between the indicia and the undimpled patch for ease in locating the position of the undimpled patch when setting up the ball for putting.

6. The invention as recited in claims 1 or 2 wherein the undimpled patch is unequally divided by a great circle which has a diameter the same as the diameter of the ball, with more of the area of the undimpled patch being below the great circle than above the great circle so that a putter with about an 8° loft may contact the approximate center of the undimpled patch in the lower half of the ball.

7. The invention as recited in claim 1 wherein an indicia is marked on the outer surface of the ball, the center of said indicia being spaced about 100° from the center of the undimpled patch, and a distinctive color band extending between the indicia and the undimpled patch as a directional indicator for placement of the ball on the green with the band showing to assure the undimpled patch being substantially positioned at the lower half of the ball.

8. The invention as recited in claim 7 wherein there are at least two undimpled patches that are substantially diametrically opposed to each other, and there are at least two indicia that are substantially diametrically opposed to each other, and there are at least two distinctive color bands, each band extending between one of the indicia to the farthest undimpled patch.

9. A golf ball as defined in claim 1 wherein outer surface a plurality of spaced dimples which substantially:

a. said undimpled patch is duplicated on the opposite side of said ball;

b. and at least one indicia marked on the outer surface of the ball, the center of said indicia being substantially equally spaced about 90° from the centers of the two undimpled patches, the indicia being located at the theoretical top pole of the sphere while the two undimpled patches are located on the theoretical equator of the sphere; and c. color bands extending from the indicia toward the two undimpled patches to facilitate the identification of the location of the patches when the player is standing over the ball in a putting position with the indicia positioned at the top of the ball and with said color bands being sight lines to be used to line up the direction player wishes ball to travel.

* * * * *